US006644604B1

(12) United States Patent
Young

(10) Patent No.: US 6,644,604 B1
(45) Date of Patent: Nov. 11, 2003

(54) GOLF BAG STAND

(76) Inventor: Michael L. Young, 1028 Chickasaw, Altus, OK (US) 73521

( * ) Notice: Subject to any disclaimer, the term of this patent is extended or adjusted under 35 U.S.C. 154(b) by 0 days.

(21) Appl. No.: 10/033,812

(22) Filed: Dec. 26, 2001

Related U.S. Application Data

(60) Provisional application No. 60/259,421, filed on Dec. 30, 2000.

(51) Int. Cl.[7] ..... A63B 55/00

(52) U.S. Cl. ..... 248/96

(58) Field of Search ..... 248/96, 97, 174, 248/351; 224/42.33, 274, 571, 901; 206/315.3

(56) References Cited

U.S. PATENT DOCUMENTS

| | | | | | |
|---|---|---|---|---|---|
| 1,058,908 | A | * | 4/1913 | Schoenthaler | 52/687 |
| 2,007,709 | A | | 7/1935 | Eppens | |
| 3,263,820 | A | * | 8/1966 | McFadden | 211/60 |
| 3,884,439 | A | * | 5/1975 | Jeninga | 248/96 |
| D312,531 | S | | 12/1990 | Shere | |
| 5,088,635 | A | * | 2/1992 | Taylor | 224/274 |
| 5,400,933 | A | | 3/1995 | Murray | |
| 5,452,773 | A | * | 9/1995 | Hrupka | 180/216 |
| 5,465,840 | A | | 11/1995 | Joh | |
| 5,480,078 | A | | 1/1996 | Verrette | |
| 5,497,891 | A | * | 3/1996 | Hannon | 211/71 |
| 5,497,964 | A | * | 3/1996 | Hagiwara | 248/96 |
| 5,505,300 | A | | 4/1996 | Joh | |
| 5,520,316 | A | | 5/1996 | Chen | |
| 5,556,064 | A | | 9/1996 | Cowe | |
| 5,575,413 | A | * | 11/1996 | Starry | 224/274 |
| 5,819,493 | A | * | 10/1998 | LeMoignan | 52/678 |
| 5,875,943 | A | * | 3/1999 | Frandsen | 224/42.33 |
| 5,927,519 | A | * | 7/1999 | Koonts | 211/86.7 |

* cited by examiner

*Primary Examiner*—Ramon O. Ramirez
*Assistant Examiner*—Amy J. Sterling

(57) ABSTRACT

A golf bag stand for supporting a golf bag and the clubs in it particularly when the bag and clubs are being transported in a motor vehicle. The open end of the bag is maintained in an elevated position with respect to the closed end or heel of the bag which is allowed to rest on the surface on which the bag and stand are placed. This orientation of the bag with the club heads in an elevated position tends to reduce or eliminate the tendency of the clubs to slide out of the bag under forces generated by maneuvering the motor vehicle due to the concentration of the weight of a club in the club head. This in turn substantially eliminates damage or marring of the club heads caused by contact between clubs or with other objects or surfaces in the trunk or other cargo space in the vehicle in which the clubs are being transported. The stand can be made inexpensively from a single piece of material, in many cases in one manufacturing operation. The stand is durable, effective and aesthetically pleasing, light, easy to carry and requires no assembly. The stand can be nested and stacked for easy and economical display and shipping, further adding to its practicality. The stand has arcuate cradling edges which engage the outer surface or collar of the bag and a plurality of feet which contact the floor of the cargo space and help hold the stand and golf bag in a stable position. Alternative forms of the stand are shown including one made of wire and one which may be hinged to the bag in a removable manner.

21 Claims, 5 Drawing Sheets

Figure 1
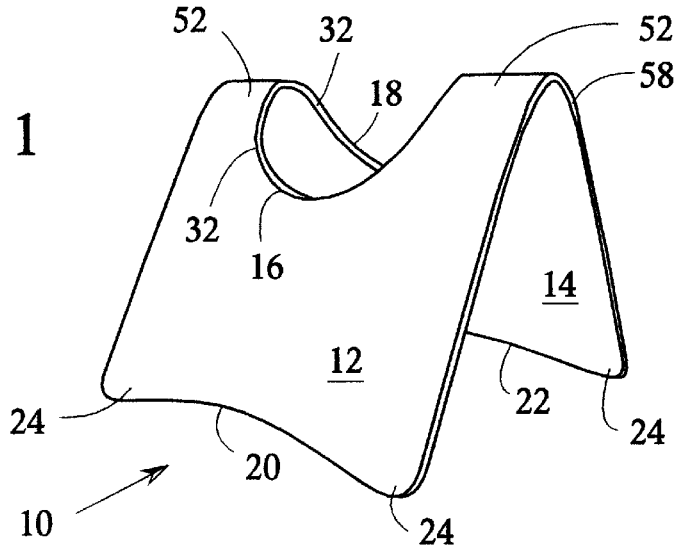
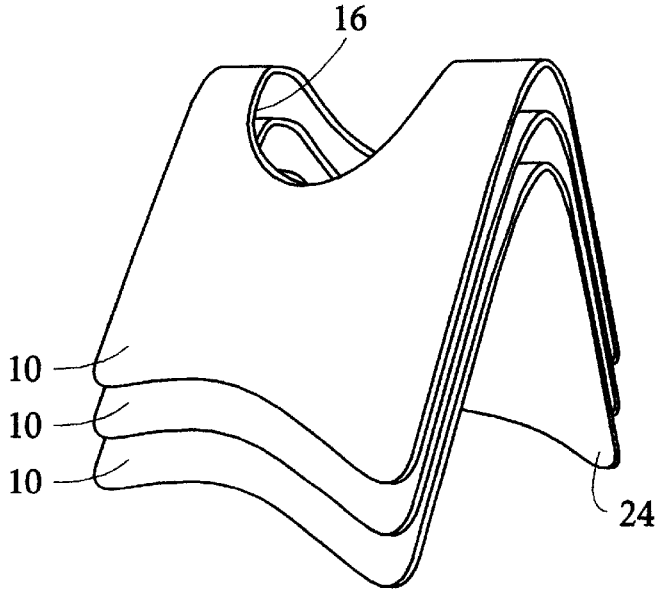
Figure 2
Figure 3
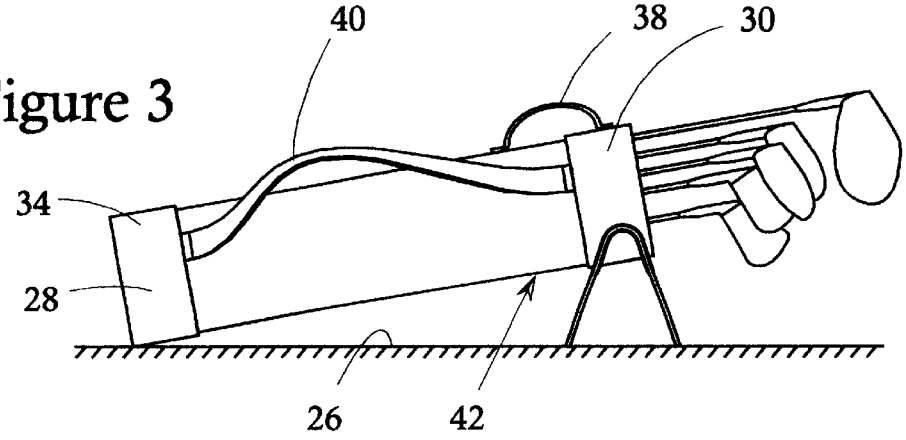

Figure 10
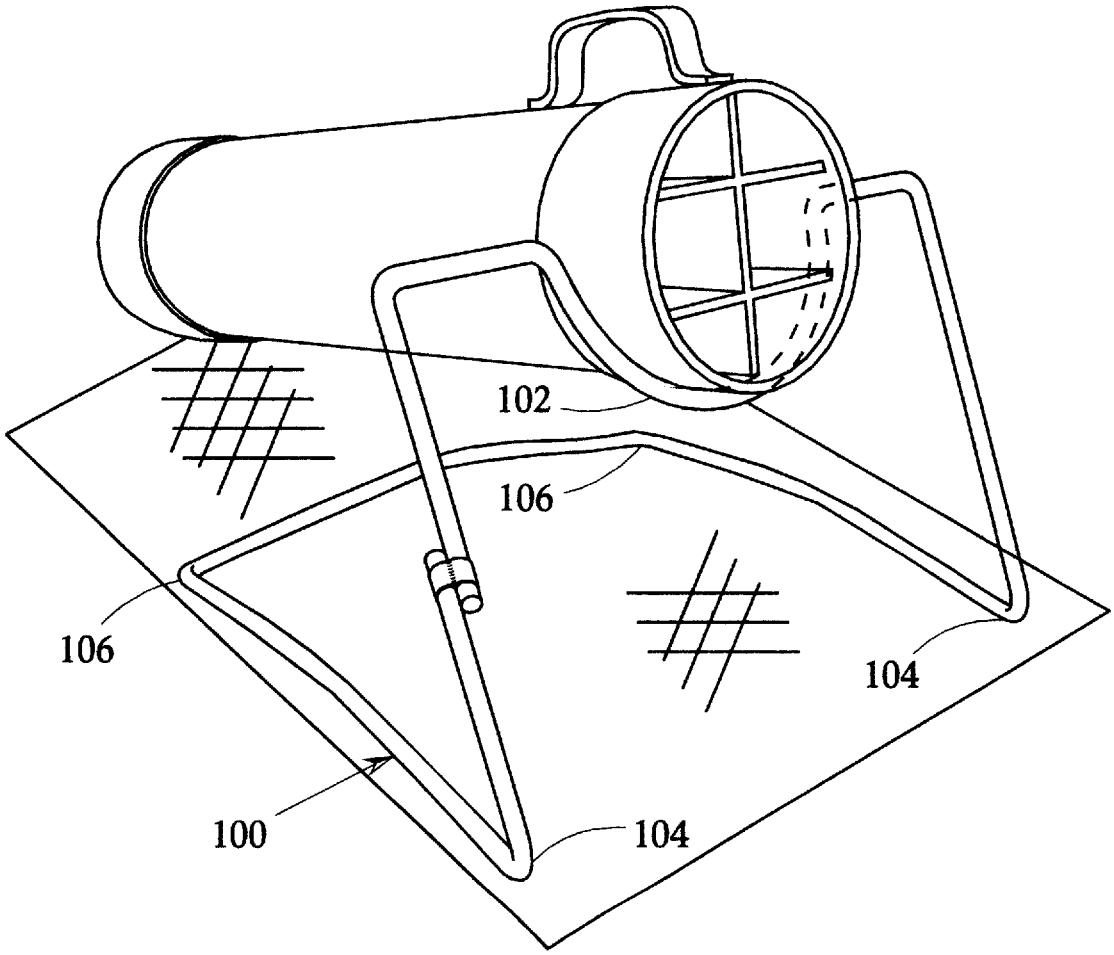
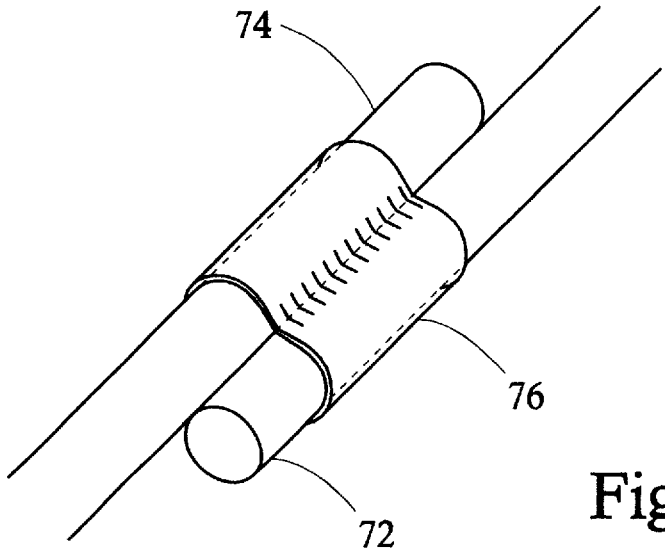
Figure 11

GOLF BAG STAND

This application is related to and claims the priority of Provisional Application Ser. No. 60/259,421 filed Dec. 30, 2000.

FIELD OF THE INVENTION

This invention relates to golf accessories and equipment, particularly such equipment and accessories related to the support and protection of a golf bag and clubs and especially to such equipment and accessories designed to protect and support a golf bag and clubs while they are being transported in the trunk or other cargo space in a motor vehicle.

BACKGROUND OF THE INVENTION

The typical golfer lives at a location remote from the location of the golf course and transports his clubs in a golf bag which is placed in the trunk or other cargo space in a motor vehicle which he or she drives to the golf course. The vehicle is often shared with one or more other golfers who also share the space in which the clubs are placed. Because of the nature of the clubs, with a concentration of weight in the club head, the clubs tend to slide out of the bag and the club heads bump and scrape against each other, tending to mar and damage the club heads. This effect is amplified when two or more bags and sets of clubs are carried next to each other. In addition, once the clubs are partly ejected from the bag the movement of the vehicle as it is being driven around curves, up and down hills and accelerated and decelerated tends to jostle the clubs and further cause impact of the clubs against each other and against the walls and floor of the cargo space, additionally exposing them to potential damage.

In recent years the cost of golf equipment, especially clubs, has increased considerably. The owners of these expensive clubs are often zealous in their efforts to protect their clubs from any kind of damage and to maintain their appearance. However, the desire to protect golf clubs is not limited to owners of expensive clubs. It is important to any golfer to maintain the appearance and condition of his or her golf clubs and avoid unnecessary damage to them or deterioration of their appearance. While some attempts have been made to prevent or reduce the movement and displacement of golf clubs while being transported in a vehicle to help reduce the possibility of damage to the clubs, none of these attempts have succeeded in avoiding the undesirable results and in many cases the apparatus made available is heavy, cumbersome, expensive and often ineffective.

There is still a need for a means of protecting golf clubs from the type of damage and deterioration described above and which is available to and practical for all golfers whether or not their clubs are of the type considered expensive. The present invention is believed to provide such a protective means.

SUMMARY OF THE INVENTION

According to the present invention there is provided a golf bag stand which helps to support a golf bag and the golf clubs in it in a manner to substantially reduce or even eliminate the likelihood of damage or deterioration of the appearance of the clubs by virtue of their coming out of the bag and being bumped and scraped or scratched by contact with each other or with the walls or other structures of the trunk or other cargo space of a motor vehicle in which they are being carried.

The stand comprises two generally vertical support panels joined together at their top ends which have arcuate cutouts to engage one end of a golf bag in a cradling fashion and keep it suspended above the surface on which it is placed.

In a preferred form the stand is molded in one piece or may be stamped from a single piece of sheet material. It provides a support which cradles the open end of the bag and steadies it and the clubs which are placed in it from rolling and pitching motion which might cause the clubs to fully or partly come out of the golf bag and to bump and/or slide against each other causing defacement or damage to the clubs. The support is feet at the four corners of the stand and which corners may lie substantially outward from the lateral dimensions of the bag while the upper portion has arcuate portions which conform generally to the approximate diameter of typical golf bags. A substantial range of golf bag sizes can be accommodated with one dimension of arc of the support. Extreme deviations of size can be accommodated by providing several sizes of stands with support portions which have larger or smaller arcs to hold larger or smaller bags.

In this invention the open end of the golf bag and the heads of the clubs in it are maintained in an elevated position which tends to cause the clubs to slide into the bag rather than out of it and helps reduce contact between adjacent club heads. With the relatively wide stance of the feet of the stand and the relatively low center of gravity of the stand and clubs, there is also little tendency of the stand to fall over on its side or to spill the clubs out of the bag.

The stand holds the top of the bag in an elevated position when the bag and stand are placed on a more or less level floor or base structure, such as when placed in the trunk of a car. When the clubs remain in their separated condition, substantially as is dictated by the tubes and/or partitions commonly provided in the bag, the probability of the club heads bumping and scraping each other is virtually eliminated. The stand is provided with feet which have a fairly wide stance relative to the diameter of the golf bag. This reduces the possibility of the bag and clubs from rolling or falling over and further maintains them in a steady, separated condition. To use the stand, the golf bag is placed in the arcuate cradle in the top of the stand with the bottom rear or heel of the bag resting on the floor of the vehicle.

To even further support and maintain the bag and clubs in a safe, steady position, the stands may be provided with means to secure the golf bag to the stand. For example, the stands may be provided with straps which encircle the collar commonly provided around the open end of the bag and can be tied to each other by suitable means such as hook and loop fasteners, snaps or other devices to keep the top of the golf bag in contact with the stand.

If desired the golf bag can be protected from possible injury by the edge of the material from which the stand is constructed by providing a protective bead or welt around the cradle portion of the stand which contacts the bag. This is particularly appropriate when the stand is made of sheet metal. The bead may be made of any suitable material such as rubber, fabric, plastic or rubber foam or plastic foam and may be attached by any available and appropriate means such as ceenting, sewing or simply by providing a slot in the protective bead and slipping it over the edge of the material of the stand.

It is also desirable to construct the stands so that both of the arcuate edges contact the collar and/or bag when a bag is placed on the stand as described above. This would tend to reduce the unit pressure applied to the bag and the possibility of damage while at the same time improving the operation of the stand to support and maintain the golf bag and clubs in a desired position. In this form of the stand, the arcuate upper support edges of the stand are at relatively different elevations from the floor of the trunk or other enclosure such that when the heel of the bag is placed on the floor of the trunk both of the arcuate edges of the stand are in contact with a side of the bag or collar or one edge could contact a side of the bag and the other edge could contact the collar.

Various readily available and well known means may be used to construct the stand and it may be made from a wide variety of available materials. For example, the stand may be cut or sculpted from wood, die cut, stamped or cast from various metals or sheet materials or molded or formed from plastic. If stamped from sheet metal, or otherwise produced from sheet material, the parts can be laid out to take advantage of their complementary shapes and virtually eliminate scrap and waste material.

While the invention has been described primarily in connection with its application and use with the support and transportation of golf clubs and golf bags, it is not restricted to such use and could find utility in carrying other objects such as tools, furniture or similar or different items.

OBJECTS AND ADVANTAGES OF THE INVENTION

It is an object of this invention to provide a practical, inexpensive stand for a golf bag and clubs so that they may be transported in a vehicle in a safe, stable manner.

Another object of this invention is to provide such a stand which can be made in one operation from a unitary piece of material.

Still another object of this invention is to provide such a stand which can be molded in one piece.

Yet another object of this invention is to provide such a stand which can be manufactured easily and economically from readily available material.

It is also an object of this invention to provide a stand for stabilizing a golf bag and golf clubs which is durable and effective and at the same time aesthetically appealing.

A further object of this invention is to provide such a stand which can be easily cleaned and maintained in a useful condition.

Another object of this invention is to provide a stand for a golf bag which is lightweight, strong and durable and requires no assembly.

These and other objects and advantages of the invention will become more readily apparent to those persons skilled in the art from the following detailed description particularly when such description is read in conjunction with the attached drawings and the appended claims.

BRIEF DESCRIPTION OF THE DRAWINGS

FIG. 1 is a perspective view of a preferred form of the invention.

FIG. 2 is a view illustrating how a plurality of the stands of FIG. 1 can be placed in a nested or stacked relationship, the stands being shown in spaced relation with each other.

FIG. 3 shows the stand of the invention in use to stabilize and support a golf bag and clubs.

FIG. 10 shows the golf stand of the present invention in a form in which it can be made of wire.

FIG. 11 illustrates a means of securing the ends of the wire type of stand to each other to complete the stand.

DESCRIPTION OF THE PREFERRED EMBODIMENTS

Figure 4:
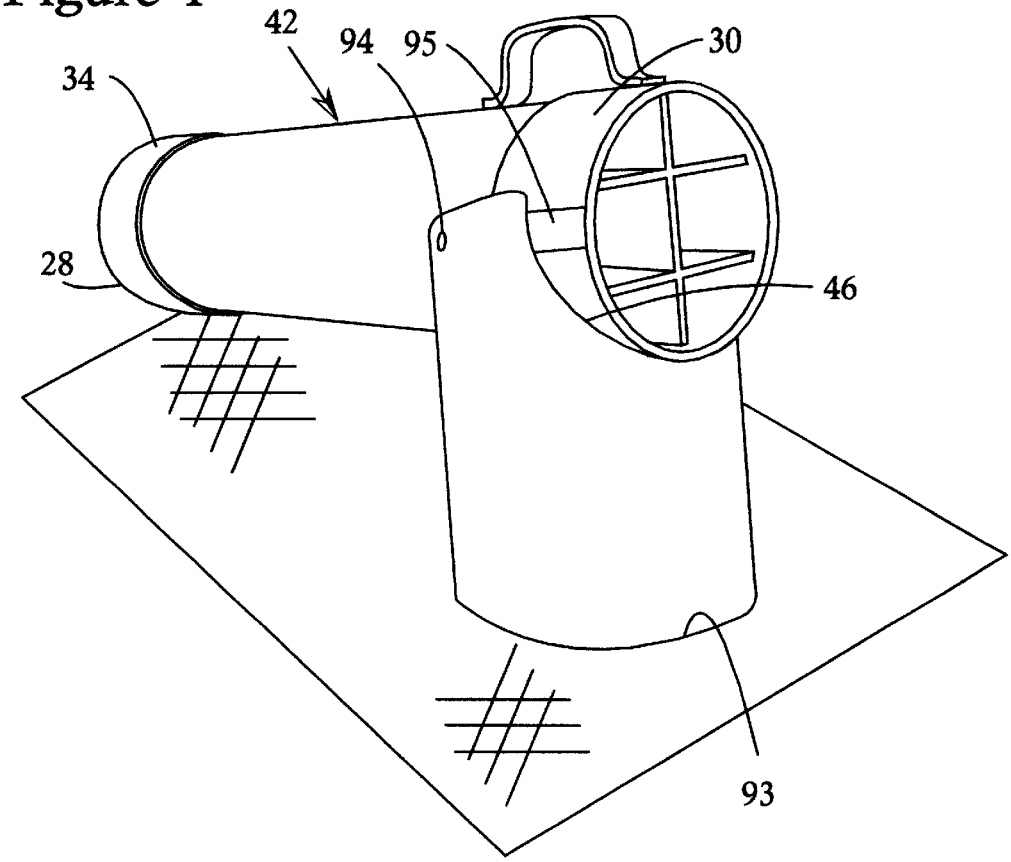
FIG. 4 shows an alternative form of the invention which is pivotally secured to a golf bag so that it can selectively be moved into or out of bag supporting position as desired but always remains with the bag so that it cannot be forgotten or misplaced.

Referring now to the drawings, in which, for the sake of clarity and ease of reference, like parts are identified with like reference numbers, the golf bag stand of this invention is indicated by the number 10.

The stand comprises first and second vertical panels 12 and 14 respectively each of which panels has upper arcuate cutouts 16 and 18 respectively. These cutouts may be circular or elliptical, the elliptical form being preferred because it can provide relatively greater contact between the cutouts and a wider variety of sizes of golf bags. It can be seen that if a circular piece of material is removed and the panels are bent in an arc whose center is at about the center of the circle of the material which is removed, the remaining part of the arc will actually be non-circular and can provide contact with the collars of various sizes of golf bags. The first and second panels of the stand have second arcuate cutouts 20 and 22 respectively to provide feet 24 at each of the corners of the first and second panels. These feet provide contact with the floor or surface on which the stand is being used. As seen in FIG. 1, the edges of feet 24 are plain and smooth but it is within the scope of the invention to make the edges serrated or of any other form which would help the feet hold the stand in a relatively stationary position especially when the weight of the clubs is placed on the stand. It is obvious that the feet can be positioned outwardly on the stand to provide a wider stance and greater stability. It may be practical to apply a length of hook fabric to the feet of the stand so that the hooks will engage the pile of a carpet or pad on which the stand may be placed, in this manner providing hook and loop adhesion between the stand and the floor or other surface on which the stand is placed. Hook and loop type fasteners may also be applied to the heel 28 of the golf bag and/or to the edge 32 of one or both of the arcuate cutouts 16 and 18 of each of the first and second panels and to the portion of the bag which will contact the cutouts. This will tend to increase the positional stability of the golf bag and stand within the vehicle in which they are being carried.

FIG. 2 illustrates how the stand 10 can be stacked or nested to reduce the space needed for display and/or shipping and thus to facilitate display and reduce the cost of shipping the product or displaying it for sale. It is well known that shipping costs and the availability of display space in point of sale displays are very important and sometimes critical in determining whether or not a product will be carried by a retailer.

As best seen in FIG. 3 many golf bags, particularly those of relatively high quality include structure substantially as follows: There is a top collar 30 of substantially rigid material, often leather with metallic or plastic backing, a lower collar or ring 34, at least in part supported by a bottom tray, not seen, and in some cases ribs or stays, not seen, which connect the top collar and lower ring and help provide overall structural rigidity to the bag; the bag is covered with fabric, leather or the like and is provided with a handle 38 and shoulder strap 40; many bags are provided with separators, seen in FIG. 4, and/or tubes, to segregate clubs into groups and specific clubs within groups.

The invention is described in relation to the general type of golf bag as described above, but is not restricted to or intended to be limited to use with such a bag and may be employed with substantially any golf bag in which golf clubs are carried and/or may be transported.

Turning now to FIG. 4, there is shown a golf bag 42 having a lower ring 34 and a collar 30 adjacent the open end 47 of the bag. A support panel 44 is secured to collar 30 by means including pivots 94 and brackets 95 which allow the panel 44 to swing from a first position in which the support panel is in a stored position adjacent to and partially surrounding the bag to a second position in which the panel 44 functions as a stand supporting the open end of the bag in an elevated position with respect to a support surface on which the heel 28 of the bag is resting. Support panel 44 is curved in a manner which allows the panel to be pivoted back around the bag and in relatively close complementary relation to the bag. This is the storage position. From the storage position the bottom end of panel 44 can be pivoted in a direction which will move the feet 24 to the right in FIG. 4 so that the collar 30 of the bag will rest on the arcuate cutout 46 and the golf bag and clubs will be supported on the heel 28 of bag 42 and the edge 93 of support panel 44. The angle between a longitudinal centerline of the golf bag and a longitudinal centerline of the panel 44 is at least 90° and preferably somewhat greater in the position of panel 44 shown in FIG. 4. This form of the invention has the advantage of keeping the support with the bag at all times, avoiding the possibility of misplacing or forgetting the stand. Support panel 44 can be made of resilient material so that it can be detached from pivot point means 94 when desired.

Figure 5:
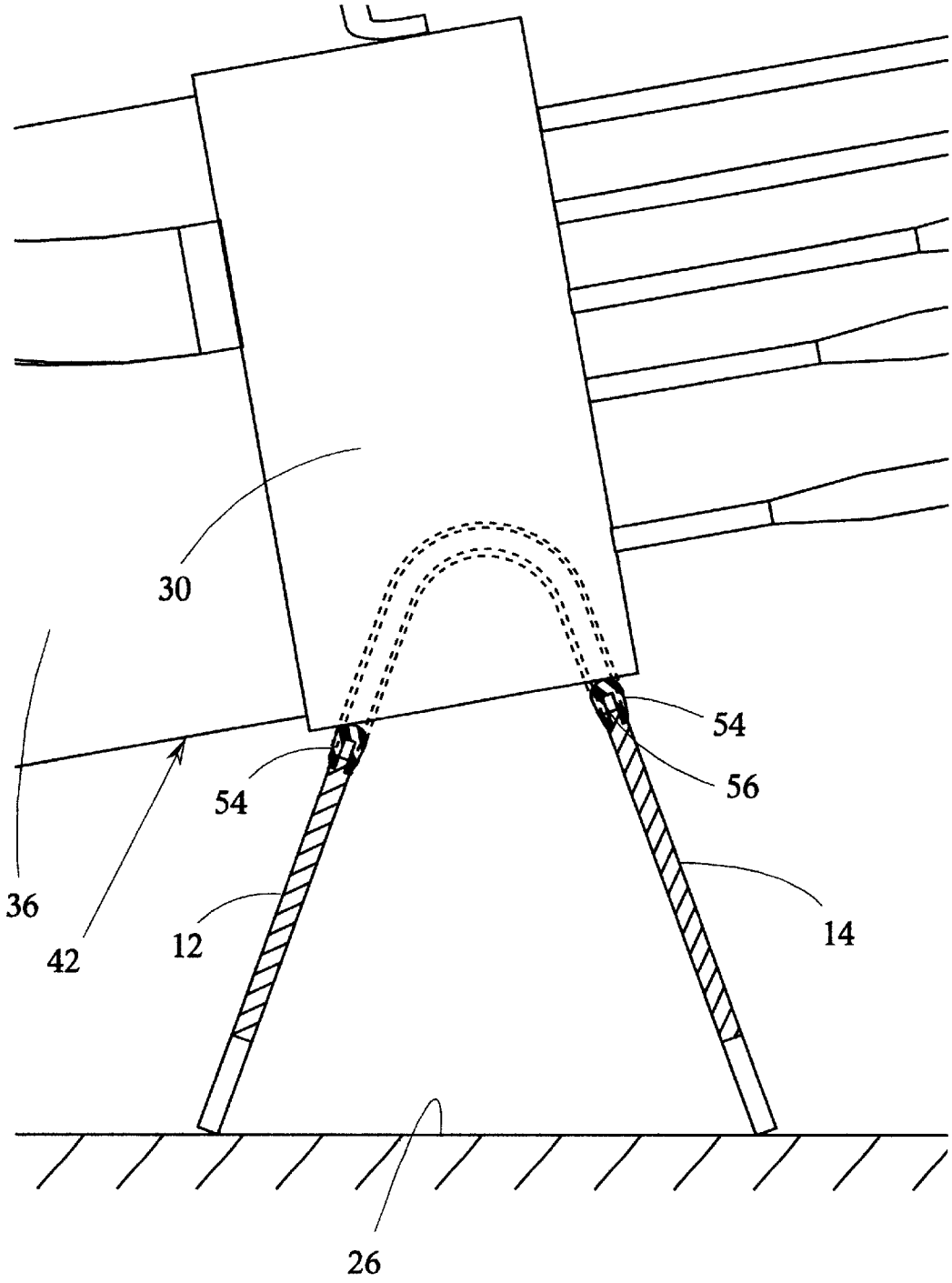
FIG. 5 is a cross-sectional view of the stand while in use, the stand only being in cross-section.

FIG. 5 is a view of the stand 10 in use with a golf bag, the stand only being shown in cross-section. When in use, the golf stand 10 is supported on all four of feet 24 with the heel 28 of golf bag 42 resting on the support surface 26 and the collar 30 of the golf bag being supported on the cradling cutouts of panels 12 and 14 and in some cases with the bag cover 36 resting on one of the cradling cutouts, depending in part on the structure of golf bag 42. In the case of the structure shown in FIG. 6, the collar and bag cover will be supported on the cradling support surface 37 with the heel 28 of golf bag 42 on support surface 26.

Figure 7:
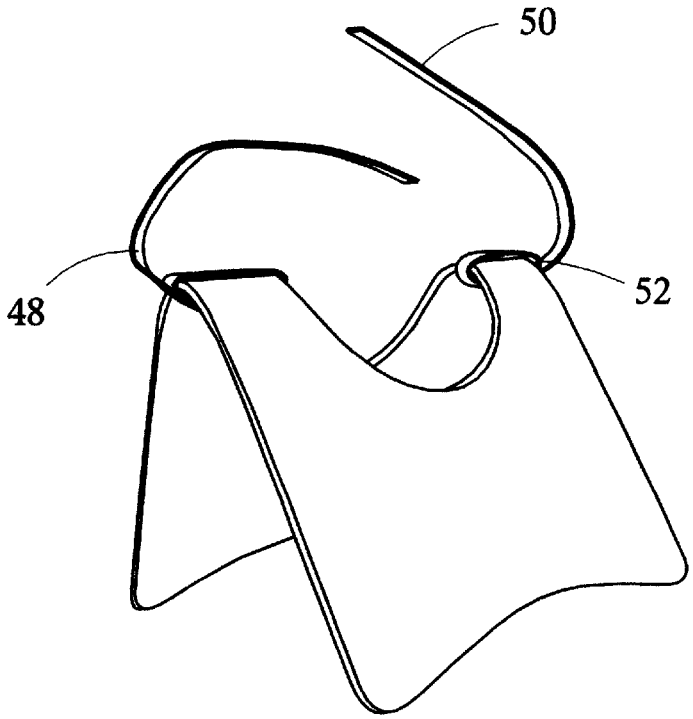
FIG. 7 illustrates a form of the invention in which the stand and the golf bag it supports are secured to each other by adjustable securing means such as straps which have hook and loop portions.

In FIG. 7, the stand is shown with a pair of anchor straps 48 and 50 secured to the bight portions 52 of the stand 10 by means not shown but which can include adhesives, rivets, hook and loop fasteners or other suitable means. One of the straps is provided with hooks and the other with loops so that they can be drawn over a bag and attached to each other after the bag is placed on the stand and will keep the bag in position. The straps are readily adjustable to secure golf bags of various sizes. Of course, various other available types of means can be used to keep the bag in position on the stand.

As previously mentioned, the arcuate cradling cutouts 16 and 18 may be of circular, elliptical or other arcuate shape, the non-circular shapes being generally capable of adjusting to various sizes of golf bag collars while providing greater surface contact between the surface of the bag collar and the edge of the cradling cutouts. This would help reduce the likelihood of damage to the golf bag and more effectively act to stabilize the bag while it is being transported. The bag holding cutouts could have straight sides as well, but arcuate shapes are preferred.

Figure 9:
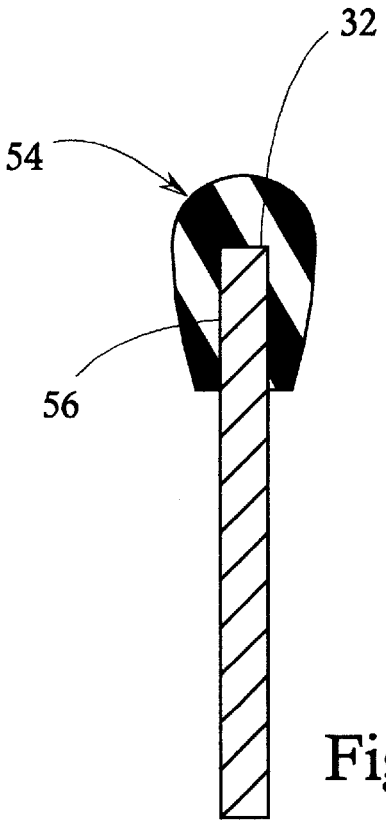
FIG. 9 is an enlarged segmental cross-section of an edge of the stand showing the use of a protective bead on the edge of a stand to cushion the contact between the golf bag and the edge of the stand.

In FIG. 5 a golf bag is shown resting on cushioning beads 54 which have slots or slits 56 which are slid on to the edges 32 to protect the surfaces of a golf bag placed on the stand. An enlarged cross-section of the protective or cushioning beads and the sheet material on which they are used appears in FIG. 9. The protective bead may also be placed on the outer edge 58 of the golf stand to protect and cover the edge 58 and to improve the aesthetic appearance of the stand. This also avoids the necessity of having to smooth or otherwise finish the edges of the golf bag stand and helps avoid injury to the user. The protective bead 54 may be made of any suitable available material and may be attached to the stand by any suitable material or means now known or which becomes known.

Figure 8:
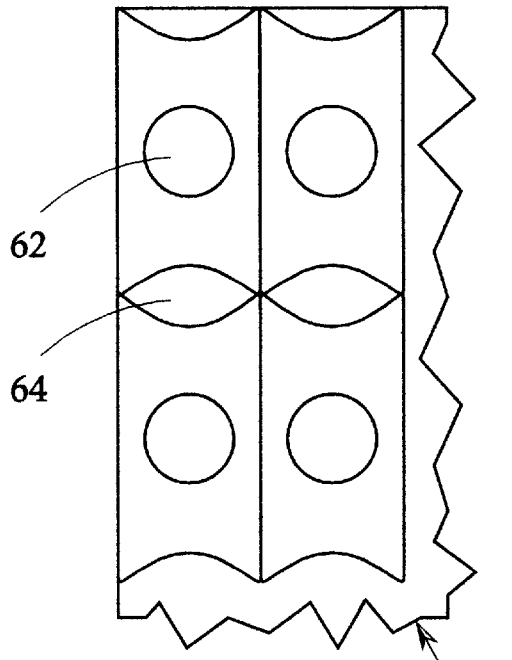
FIG. 8 is an illustration of a layout of stands to be stamped out of a sheet of material in a manner which reduces scrap and conserves material.

In the event that the stand is manufactured by punching or stamping it from sheet material such as sheet aluminum or galvanized iron, the layout shown in FIG. 8 may be used to reduce the cost of the stampings. In this layout the pieces are arranged on a sheet 60 of material to reduce the amount of scrap or waste material. Pieces 62 of a shape which will produce the arcuate cutouts 16 and 18 are punched out as are pieces 64 to produce second arcuate cutouts 20 and 22 and the feet 24 of stand 10. As can be seen, a minimum of material is scrapped or wasted. This will help keep the cost of the golf stand low and the item more salable and profitable. As can be seen by referring to FIG. 8, if pieces 62 are circles, when the sheets are folded along a curving fold, the edges 16 and 18 will be of the desired segmental arcuate shape. As the center of the circle punched out to form the arcuate cradling edges is moved slightly toward the end of the blank in a direction toward what will become cradling edge 16, then the height of arcuate cradling edge 18 will be greater than the height of arcuate cradling edge 16 above the support surface 26 and the bag will be supported by both edges 16 and 18.

Figure 6:
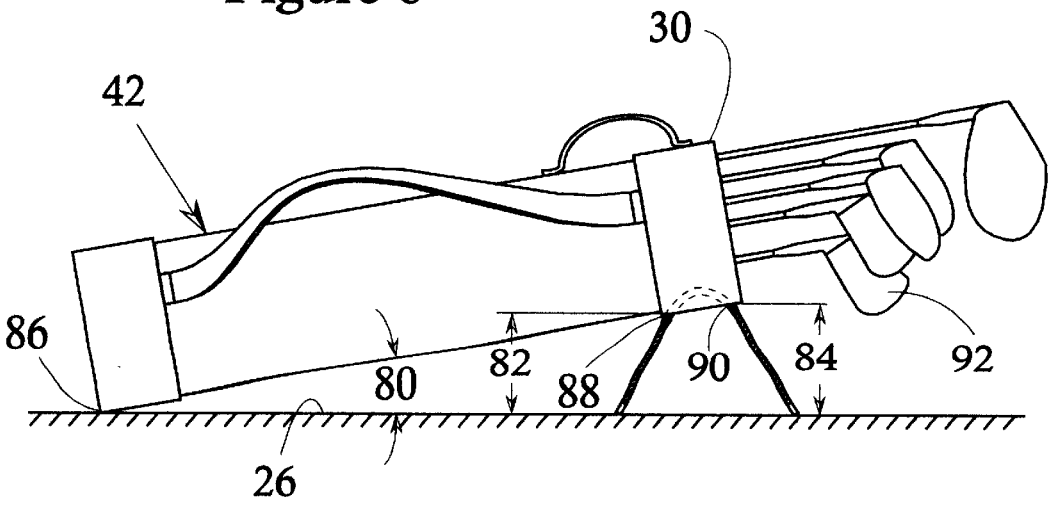
FIG. 6 illustrates an alternative form of the invention in which the upper portion of the stand which contacts the collar portion of the golf bag is a continuous surface.

As seen in FIG. 6 golf bag 42 is supported at contact point 86 between the heel of the bag and the support surface 26, at contact area 90 between the surface of collar 30 of the bag and the second arcuate cradling cutout 18 and at contact area 88 between the surface of the bag 42 and the first arcuate cutout 16. The golf bag 42 forms an angle 80 with the floor 26 determined in part by the horizontal distance between point 86 and points 88 and 90 as well as the vertical distances 82 and 84 between points 88 and 90 and the floor 26. Angle 80 may have a very broad range of values. As a minimum it should be large enough so that a head 92 of a golf club does not contact the surface of floor 26 of a vehicle or trunk in which the bag is being transported and also so that the tendency of a club to slide out of the bag is eliminated or greatly reduced. The maximum angle would be just below that at which the center of gravity of the bag and clubs is raised to a level at which the bag and clubs would tend to fall over easily when the vehicle in which they are being transported is being maneuvered. The length of the bag and clubs would determine in part the minimum angle

80 and the height of the useful space would determine in part the maximum value of that angle. Angles between about 5° and 45° may be used and angles between about 10° and 25° are preferred and an angle of about 15° is further preferred. The selection of angle 80 will of course depend on the median length of a golf bag with which the stand may be used. The median length of a golf bag may be between about 30 and 36 inches and the median diameter of the collar of a golf bag may be between about 8 and 10 inches. These dimensions and the dimensions of the golf bag stand of the invention based upon them are to be taken only as examples and not in any way as limiting the invention.

It will be readily noticed that if the golf bag in FIG. 6 is moved slightly to the right in the drawing, the golf bag will be supported entirely by stand 10 and the heel of the bag will not make contact with the support surface at point 86. The use of the stand in this manner is well within the scope of the invention but is not, on the other hand, a limitation of the invention.

The diameter of the arcuate cradling cutouts or cradling surface 37 in the stand is between about 8 inches and 12 inches. The diameter must be large enough to accommodate the largest bag it is to be used with, but small enough to provide effective support for the smallest bag. The distance between points 88 and 90 may be between about 10 and 20 inches, the horizontal distance between feet 24 on the first panel and feet 24 on the second panel may be between about 10 and 30 inches and the distance between feet 24 on the same panel may be between about 10 and 24 inches. As previously noted, these dimensions are by way of example only and in no way limit the scope of the invention.

An alternative form of the invention in which it is made of a single length of wire 66, is shown in FIG. 10. The wire may be bent over a form, not shown, to produce a stand which is light, economical and easy to carry. As can be seen the wire form has arcuate cradling portion 102 comparable to the arcuate cradling segments 16 and 18 shown in FIG. 1 as well as front foot portions 104 and rear foot portions 106 comparable to the feet 24 of the stand shown in FIG. 1. To provide the strength and integrity of the wire form as desired, the two free ends 112 and 114 of the wire from which it is made are rigidly attached to each other. The joinder of the two ends may be accomplished by welding or other means. As shown in FIG. 10, the two ends 112 and 114 can be held together by a sleeve or ring 116 which is crimped upon the ends of the wire after they have been inserted into the ring from opposite ends of the ring in overlapping relationship with each other. The free end of each end of the wire extends completely through the ring to provide a solid connection between each of the ends 112 and 114 and the securing ring. The connection may be further reinforced with an adhesive or by welding, spot welding or using similar additional joining means. In the preferred form of the stand made from wire, the jointure of the two ends of the wire is preferably made in a place where the wire is straight and at a location away from the cradling or foot portions of the stand.

A golf bag and clubs can be set in the cradle 102 and will be supported on rear feet 104 and front feet 106. Stand 100 may be made of a metallic material such as aluminum or steel wire or of polyvinyl chloride or other suitable plastic.

While I have shown and described specific embodiments of the invention, it is understood that many variations and modifications may be made to the specific arrangements and configurations shown without departing from the objectives and scope of the invention as defined by the claims.

Further, the abstract of the disclosure submitted herewith is provided for the purpose of making it possible to determine quickly the nature of the invention disclosed and not to define or limit its scope.

I claim:

1. A golf bag stand for supporting and maintaining in a relatively fixed position on a support surface a golf bag having an open end and a closed end in which clubs are being stored with the club heads projecting from said open end, said stand comprising first means for cradling and elevating the open end of such golf bag and second means for supporting said first means in position to elevate the open end of the golf bag above the closed end of such golf bag, said first and second means being substantially permanently fixed with respect to each other, said golf bag stand being constructed to be nestable with other units thereof for storing, shipping and display.

2. A golf bag stand as set forth in claim 1 in which said first and second means are integral with each other.

3. A golf bag stand as set forth in claim 1 in which said first means includes at leas one arcuate portion which engages an outer surface of the golf bag.

4. A golf bag stand as set forth in claim 1, in which said stand is constructed of a single unitary piece of material.

5. A golf bag stand as set forth in claim 4 in which said second means comprises a plurality of feet integral with said first means and constructed and arranged to each contact such support surface when the stand is in use.

6. A golf bag stand as set forth in claim 1, said stand being pivotally secured to the golf bag adjacent the open end thereof.

7. A golf bag stand as set forth in claim 1, said stand being removably secured to the golf bag adjacent the open end thereof.

8. A golf bag stand as set forth in claim 1 for supporting in an elevated position one end of a golf bag which is in a substantially horizontal position.

9. A golf bag stand as described in claim 8 in which the stand is removably, pivotally secured to the golf bag.

10. A golf bag stand as described in claim 9 in which the stand can be pivoted between an active position in which it supports and stabilizes a golf bag and an inactive or storage position in which the stand lies in a complimentary relatively close position to the outer surface of the golf bag adjacent the open end of the bag.

11. A golf bag stand as set forth in claim 1 wherein the longitudinal centerline of the golf bag is maintained in a position between 5° and 45° with the horizontal when supported by the stand.

12. A golf bag stand as set forth in claim 11 wherein the longitudinal centerline of the golf bag is maintained in a position between approximately 10° and 25° with the horizontal when supported by the stand.

13. A golf bag stand as set forth in claim 1 wherein said first means include arcuate non-circular edges that conform to and are complimentary to a portion of the adjacent surface of a golf bag which the stand is supporting.

14. A golf bag stand as set forth in claim 13 wherein said arcuate non-circular edges are made by forming a circular hole in a flat piece of material from which the stand is made and then bending the material in an arcuate manner about an axis transverse to the axis about which the circular hole was formed.

15. A golf bag stand as set forth in claim 4 in which said single unitary piece of material is a wire.

16. A golf bag stand as set forth in claim 4 in which said single unitary piece of material is molded plastic.

17. A golf bag stand as set forth in claim 1 in which said first means include adjustable means to help retain the golf bag in contact with the stand.

18. A golf bag stand as set forth in claim 1 in which said second means include means attached to said feet and engageable with a support surface to help maintain said stand in a relatively stationary position relative to said support surface.

19. A golf bag stand as described in claim 1 wherein said second means includes means attachable to a golf bag and engageable with a support surface to help maintain the closed end of the bag in a relatively stationary position with respect to the support surface.

20. A golf bag stand as set forth in claim 1 wherein said first means includes first and second panels with respective first and second arcuate non-circular cutouts, said first and second panels being positioned and said respective first and second arcuate non-circular cutouts being proportioned so that when a golf bag is placed on the stand with a heel of the golf bag resting on a support surface both the first and second arcuate non-circular cutouts will contact a portion of the outer surface of the golf bag and help support and stabilize the golf bag on the support surface.

21. A golf bag stand as set forth in claim 20 and having means applied to the edges of said arcuate non-circular cutouts to help avoid damage to the outer surface of a golf bag supported on the stand.

* * * * *